United States Patent [19]

Stanasila et al.

[11] 4,030,879

[45] June 21, 1977

[54] APPARATUS FOR DRYING CERAMIC BODIES

[75] Inventors: Virgil Corneliu Stanasila; Mihai Florica; Onut Antoniu Lungu, all of Bucharest, Romania

[73] Assignee: Institutul de Cercetare Proiectare si Documentare Pentru Industria Materialelor de Constructii, Bucharest, Romania

[22] Filed: Oct. 24, 1975

[21] Appl. No.: 625,668

[52] U.S. Cl. ..... 432/144; 432/152; 432/241; 432/258; 34/143; 34/145

[51] Int. Cl.[2] ..... F27B 9/00

[58] Field of Search ..... 432/121, 125, 126, 144, 432/152, 162, 219, 220, 241, 258; 34/143–145

[56] References Cited

UNITED STATES PATENTS

| | | | |
|---|---|---|---|
| 508,112 | 11/1893 | Miller | 34/144 |
| 1,846,614 | 2/1932 | Ronland | 432/241 |
| 2,671,160 | 3/1954 | Segsworth | 432/125 |
| 2,679,111 | 5/1954 | Leischner | 34/144 |
| 2,854,896 | 10/1958 | Manton | 34/144 |
| 2,869,856 | 1/1959 | Greene | 432/241 |
| 3,064,363 | 11/1962 | Ikenchi | 34/144 |
| 3,463,470 | 8/1969 | Greene et al. | 432/241 |

*Primary Examiner*—John J. Camby
*Assistant Examiner*—Henry C. Yuen
*Attorney, Agent, or Firm*—Karl F. Ross; Herbert Dubno

[57] ABSTRACT

An apparatus for drying ceramic bodies in which a framework of horizontal pipes and spacer bars define vertical columns beneath which a platform is disposed. The drying medium is circulated through the chamber containing the rack and through the pipes of the rack which have outlets for the cooling medium therealong. The ceramic bodies are stacked on the platform and the stacks are held pneumatically when the platform is lowered to remove the bottom article from each stack, additional articles being fed to the stack from the top. Plates on opposite sides of the stack are shifted back and forth by a crank arrangement to impart a quasi-sinusoidal movement to the gases around the bodies in the stacks.

4 Claims, 9 Drawing Figures

APPARATUS FOR DRYING CERAMIC BODIES

The invention relates to an apparatus for drying ceramic buidling products.

The drying processes and apparatus for moist, shaped ceramic building products, used in practice are thermal, convective in most cases, with atmospheric air-diluted combustion gases as thermal agent, and only very seldom are radiative.

All these processes and installations have in common the fact that, after the shaping of products, they require transportation and setting of the shaped product on drying frames (either wooden or metallic, with manual, mechanical or automatic setting). The frames are stacked and placed inside charging accumulators, from which they are taken by conveyor or transfer or drying carriages to chambers or through tunnels for drying thereafter. The products are wheeled out by conveyor, transfer or dying carriages, carried to discharge accumulators manually, mechanically or automatically hauled, mechanically or automatically loaded on burning carriages.

These systems have the following disadvantages: a relatively low product temperature during the drying & irregular and poor heat exchange between the drying agent and the product; lack of proportionality between the drying intensity and the quantity of water water amount which has to removed from the various surfaces of each product; lack of correlation between the drying requirements and the flow pattern of the thermal agent between the products; high heat losses; high power consumption of the transport means; thermal agent stratification: high temperature lag upon change-over of dryers: long drying period because of the lack of uniformity along the surfaces of the same product and from one product to another: big dryer volume; high heat specific consumption; etc.

It is an object of the invention to avoid these drawbacks, advantages of the known drying processes of the building ceramic products, by the fact that, in order to; eliminate the loading-unloading columns, the unburned and dried product accumulators, the convey, transfer and drying carriages, the product sustain frames, other sustain, pushing or extraction installations and facilities, some drying-agent recycling installations; to reduce the volume of the dryhouses and the areas they occurpy; to simplify the integral mechanisation and automation and lower their costs; to substantially shorten the drying period and improve the drying quality; to enhance the heat exchange between the products and the thermal agent along with the reduction of gross and net heat specific consumption for the water evaporation off the products; to operate easier and at lower cost; — the drying products are gravitationally, vertically, quasi-continuously moving during the drying period; ; resting one upon the others, directly or by means of clay spacers, in parallel columns; the drying regime is the same for every product; the thermal agent with a rather high moist temperature has a quasi-sinusoidally and uniformly variable speed horizontal component and the fed-in drying heat is distributed along the whole product path according to the request of the most rapid drying.

The apparatus of the invention, comprises a chamber drying with a furnace, inside of which is a rack for receiving the ceramic products, composed of horizontal pipes provided with perforations and spacer bars crossing the pipes so as to form vertical columns. A platform is provided at the lower part of the columns with a telescopic device and number of elastic cushions for the ceramic product. Fans displace the thermal agent inside the dryer and an other fan is provided for exhausting excess gaseous agent. A quasi-sinusoidal variation of the horizontal speed component of the gas flow is effected by the alternative movement of some panels, connected by bars to a crank and connecting-rod assembly, driven by an electric motor.

IN THE DRAWING

Figure 1:
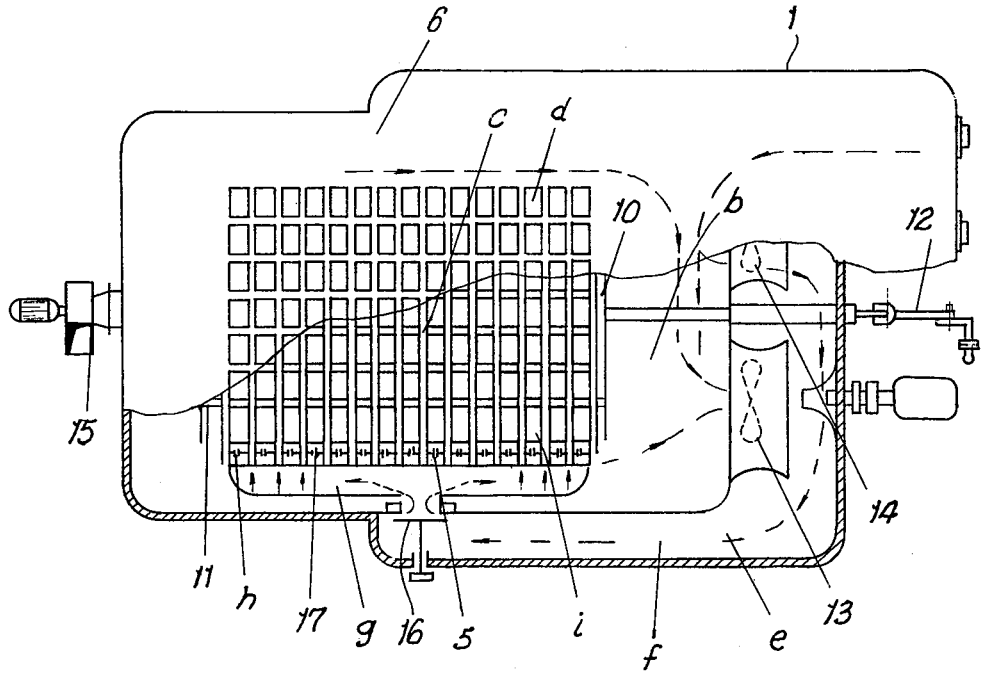
FIG. 1 is a horizontal plan view, partially in section of a drying installation for ceramic products, hollow bricks, for instance.
Figure 2:
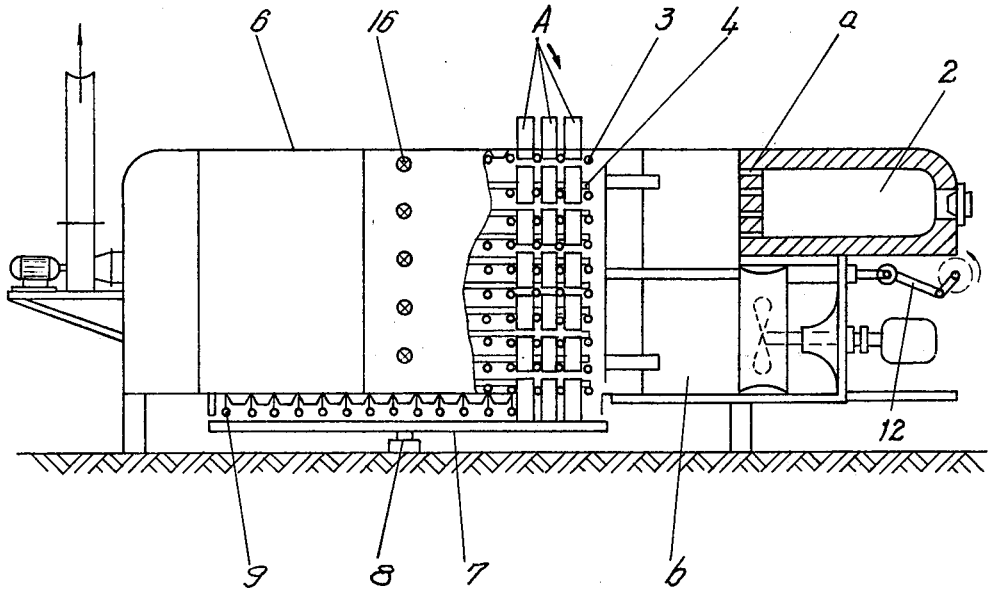
FIG. 2 is a side view of the installation.
Figure 3:
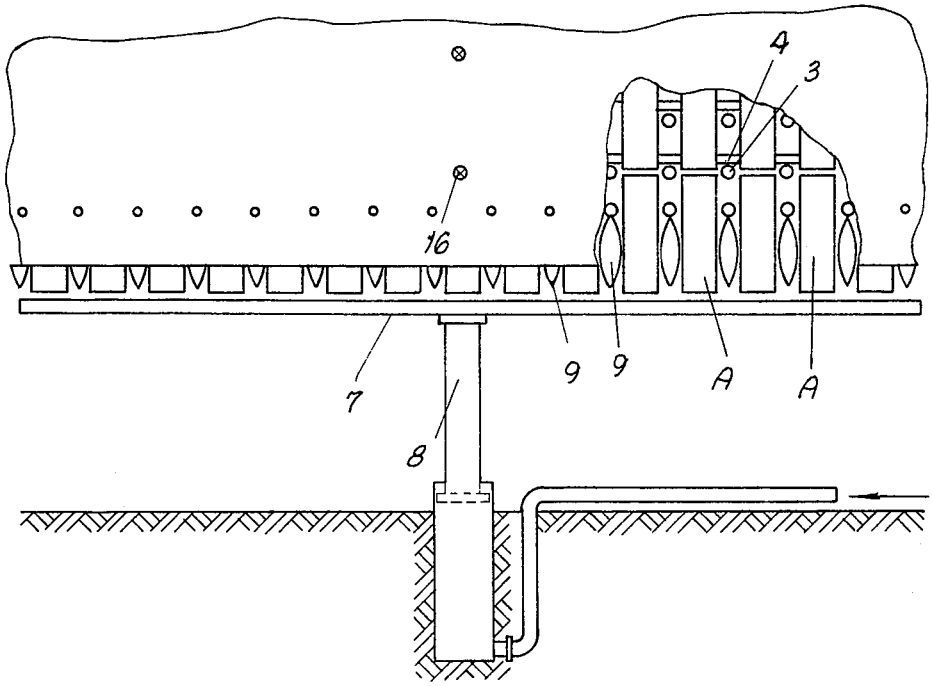
FIG. 3 is a partial side view of the lower part of the installation just before beginning the unloading of dry product.
Figure 4:
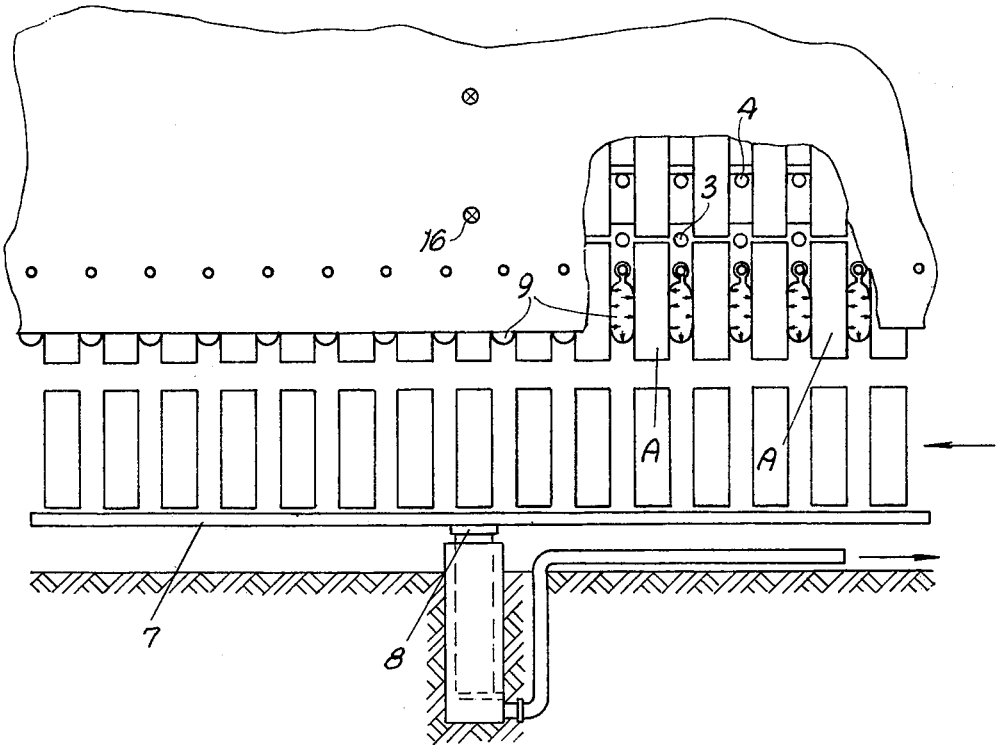
FIG. 4 is a partial side view of the lower part of the installation showing another phase of its operation.
Figure 5:
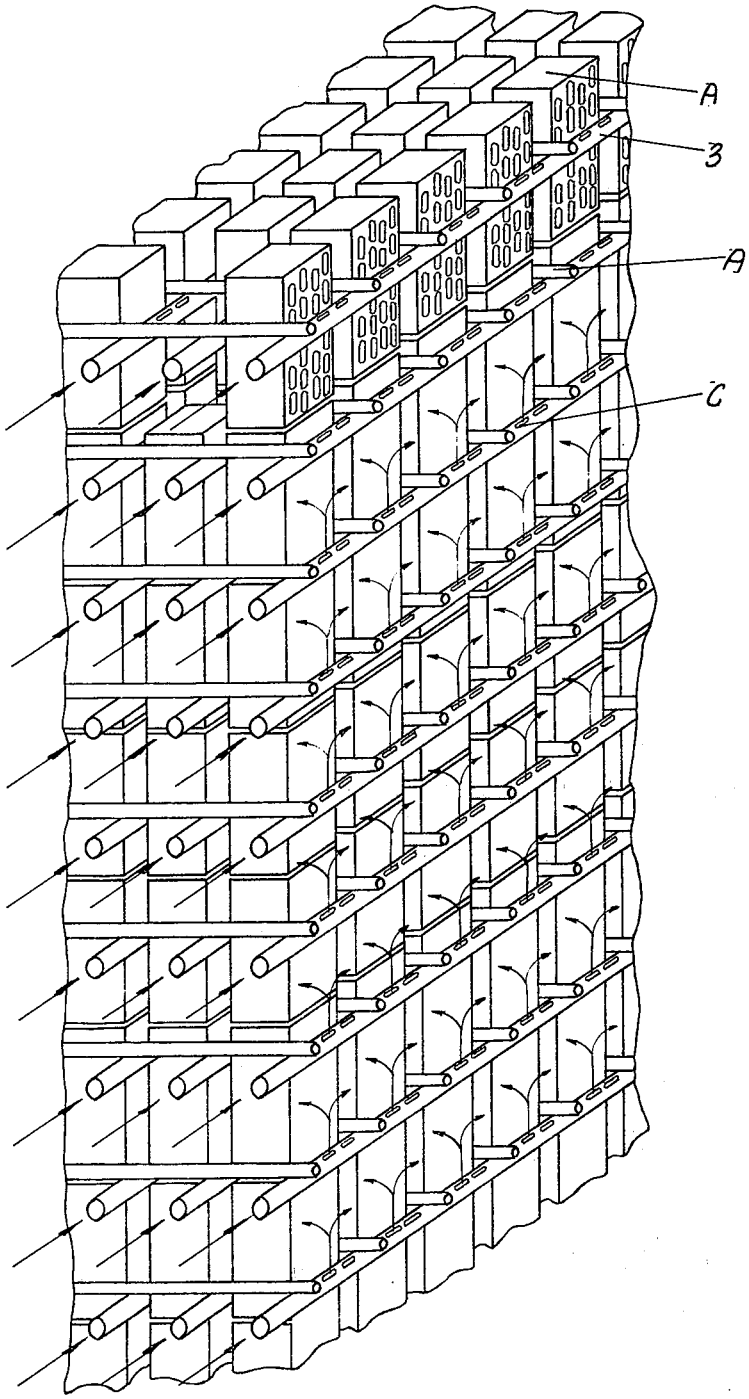
FIG. 5 is a perspective view of two rows of product circulation columns during drying.
Figure 6:
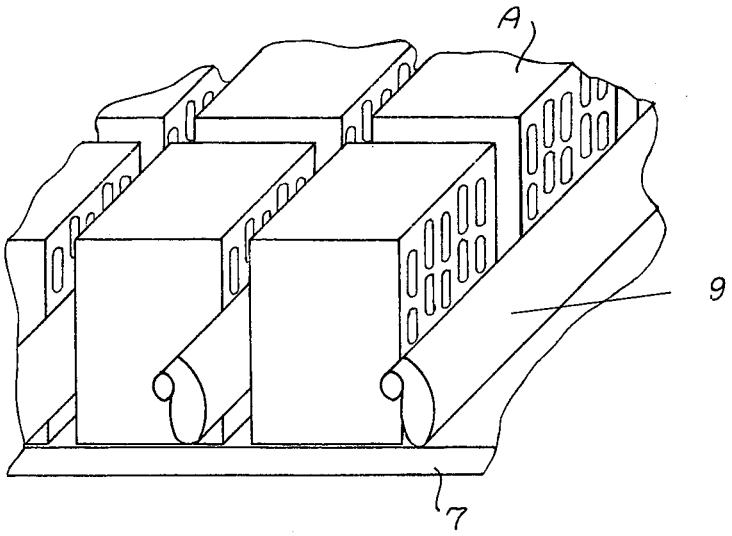
FIG. 6 is a perspective view of a section of the dry product extractor.
Figure 7:
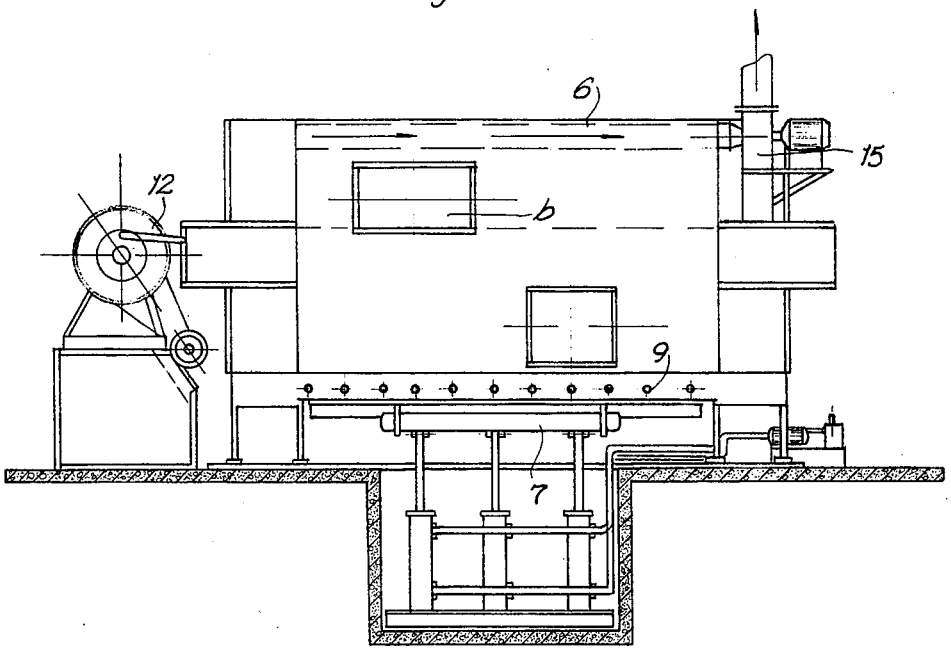
FIG. 7 is a side view of the installation illustrating another aspect of the invention.
Figure 8:
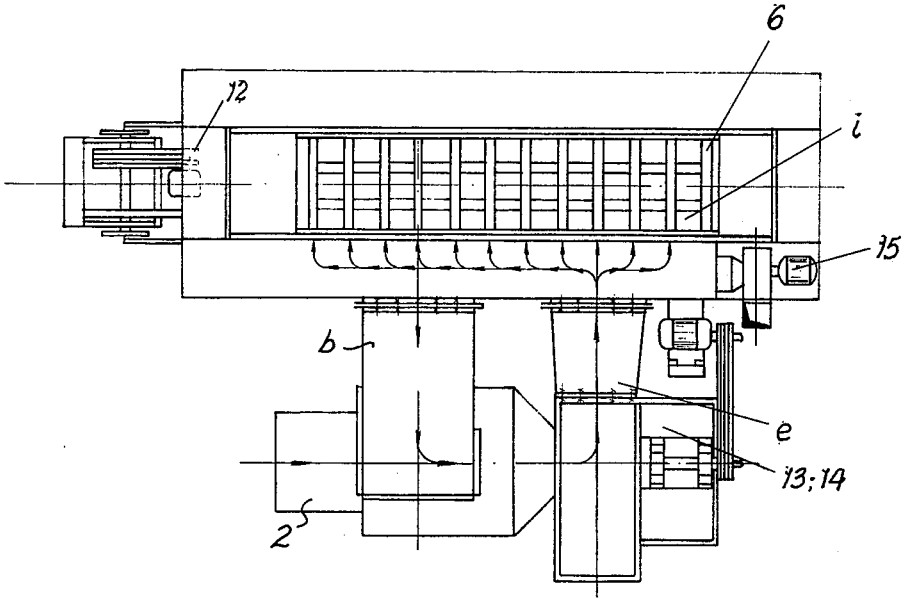
FIG. 8 is a horizontal plan view of the latter installation.
Figure 9:
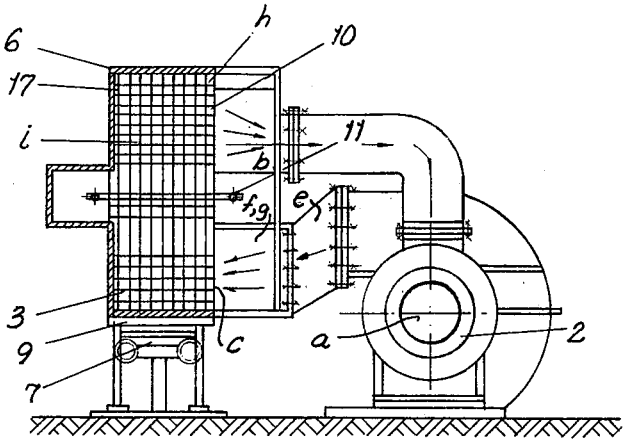
FIG. 9 is a view of the partially sectioned drying installation.

The apparatus in accordance with the invention comprises a chamber-type dryer 1 provided with a furnace 2 and with orifices *a* for the passage of the thermal agent (e.g. combustion gas from furnace 2) into a compartment *b*. The latter has a rack composed of horizontal pipes 3 provided with perforations *c*, the pipes 3 being fixed to walls 5. Above the whole rack there is a plate 6 with hatches *d* corresponding to the spaces formed by the arrays of pipes 3 and horizontal bars 4. At the lower part a platform 7 is provided with a telescopic lifting device 8, above which operate a number of pneumatic cushions 9. At the front sides of the rack there are two panels 10 linked by bars 11, the panels being driven with a straight-line alternative movement to and from the rack, by a connection-rod and crank assembly 12 driven by an engine not shown. This crank assembly reciprocates the panels 10 (to the left and right in FIG. 1) to displace gas into and out of the rack as with a fan.

To displace the thermal agent inside the installation there fans 13, 14 and 15, the latter exhausting the excess circulated thermal agent. The thermal agent circulates from the furnace 2 towards the installation through a chamber *e* communicating via a channel *f*, contiguous to the installation walls, through valves 16, with a distribution channel *g* passing through the pipes 3, the agent entering the dryer under the form of jets through the pipes 3. Excess thermal agent is withdrawn from the drying space through outlet holes *h* in walls 17, passing inside a channel *i* from which the fan 15 discharges it into the atmosphere.

The installation in accordance with the invention is used as it follows: the installation is charged through the hatches *d* of the plate 6 with ceramic products A arranged with the small base surface against the platform 7, closing each until all hatches are filled, following the previous furnace firing. The connecting-rod and crank assembly 12 as well as the fans 13, 14, 15 are actuated. Following the drying of the product, the last base-layer is extracted as set forth.

Platform 7 is lowered by means of the telescopic device 8 till the mid-height of the next to the last layer of A columns reaches the pneumatic cushions 9, which are pressurised in order to lock the columns of products. The product-carrying platform is, then, moved away and the last product layer is removed off the platform. The columns are replenished with a new unburned product layer, by the upper part, through the hatches *d* of the plate 6, the thermal agent having in the meantime being in continuous circulation inside the chamber and between the products. The burners of furnace 2 are shown (unnumbered) at the right-hand side thereof.

The main advantages of the apparatus in accordance with the invention reside in the simplification of the supporting and the transport of drying products; the exclusion of unnecessary equipment; reduction of labor requirement to increase of productivity; simplification of automobile drying; drop of consumption of thermal and electric power; and reduction of in space requirements.

We claim:

1. An apparatus for drying ceramic bodies, comprising:

a housing forming a drying chamber and a furnace which produces a heating medium;

a rack in said housing formed by an array of parallel horizontal spaced-apart pipes and bars extending transversely to said pipes to form a multiplicity of drying columns;

a platform vertically displaceable beneath said rack and adapted to be lowered to discharge the lowermost ceramic body of respective stacks thereof received in said columns from said housing;

pneumatic means at the bottom of said rack for retaining each of said stacks against downward movement at the next to the lowermost body, thereby enabling the lowermost body to be removed on said platform;

a pair of panels flanking said stack and movable to displace said heating medium into said rack and around said stacks;

crank means operatively connected to said panels for periodically displacing same to impart movement to the medium in said rack; and means for circulating said medium through said chamber and said pipes and for removing excess medium from said chamber, said pipes being provided with opening discharging said medium in the region of said stacks.

2. The apparatus defined in claim 1 wherein said housing is formed with hatches each along with the respective one of said columns for adding bodies to the respective stacks at the top thereof.

3. The apparatus defined in claim 1 wherein the means for displacing said medium includes at least one fan for drying excess medium from said chamber, at least one fan for circulating medium through said chamber and valve means for admitting at least part of the circulated medium to said pipes.

4. The apparatus defined in claim 1 wherein said housing has a wall provided with an exhaust fan.

* * * * *